US005577827A

United States Patent [19]

Leffingwell et al.

[11] Patent Number: 5,577,827

[45] Date of Patent: Nov. 26, 1996

[54] EXERCISER LIGHT ALARM STICK

[75] Inventors: Gordon H. Leffingwell, Safety Harbor; James D. O'Donnell, St. Petersburg, both of Fla.

[73] Assignee: ELA Systems, Inc., Safety Harbor, Fla.

[21] Appl. No.: 407,135

[22] Filed: Mar. 20, 1995

[51] Int. Cl.[6] ..... A45B 3/04; A63B 15/02

[52] U.S. Cl. ..... 362/102; 362/109; 273/84 R

[58] Field of Search ..... 362/102, 190, 362/253, 202, 184, 399, 296, 234; 482/108, 106; 273/84 R

[56] References Cited

U.S. PATENT DOCUMENTS

| | | | |
|---|---|---|---|
| 2,245,349 | 6/1941 | Lombardi . | |
| 2,271,190 | 1/1942 | Giaimo . | |
| 4,236,544 | 12/1980 | Osaka | 135/66 |
| 4,756,524 | 6/1988 | Cooney | 272/97 |
| 4,819,137 | 4/1989 | Hamilton | 362/102 |
| 4,887,625 | 12/1989 | Archer | 135/75 |
| 5,032,824 | 6/1991 | Corbin | 340/574 |
| 5,041,951 | 8/1991 | Fan | 362/102 |
| 5,086,377 | 2/1992 | Roberts | 362/102 |
| 5,149,092 | 9/1992 | Parsons | 273/84 |
| 5,266,927 | 11/1993 | Sanders | 340/574 |
| 5,287,255 | 2/1994 | Strodtman | 362/102 |
| 5,370,407 | 12/1994 | Whalen | 280/809 |

*Primary Examiner*—Denise L. Gromada
*Assistant Examiner*—Thomas M. Sember
*Attorney, Agent, or Firm*—David W. Pettis, Jr., P.A.

[57] ABSTRACT

A flashlight is disclosed having a tube with an extension, a grip wrapped about its exterior, and a light in one end of the tube including a reflector with a bulb inside, and a switch connected to the bulb and to a battery, the tube also containing an alarm being a buzzer and a switch connecting the buzzer to the battery.

2 Claims, 4 Drawing Sheets

EXERCISER LIGHT ALARM STICK

BACKGROUND OF THE INVENTION

The present invention relates to an EXERCISER LIGHT ALARM STICK that is extendable for use as a cane. The present invention combines a light and an alarm with an extendable exercising stick which can be also be used as a cane.

SUMMARY OF THE INVENTION

A flashlight is disclosed having a tube with an extension, a grip wrapped about its exterior, and a light in one end of the tube including a reflector with a bulb inside, and a switch electrically connected to the bulb and to a battery, the tube also containing an alarm being a buzzer and a switch electrically connecting the buzzer to the battery.

As a result of the novel combination of the various advantageous feature of the present invention, the EXERCISER LIGHT ALARM STICK provides for convenience and ease of manufacture heretofore not available.

Accordingly, the invention comprises an article of manufacture possessing the features, properties, and relation of elements which will be exemplified in the article of manufacture hereinafter described and the scope of the invention will be indicated in the claims.

BRIEF DESCRIPTION OF THE DRAWINGS

For a full understanding of the nature and objects of the invention, reference should be had to the following detailed description taken in connection with the drawings in which.

Similar reference characters refer to similar parts throughout the several views of the drawings.

DESCRIPTION OF PREFERRED EMBODIMENT

Figure 1:
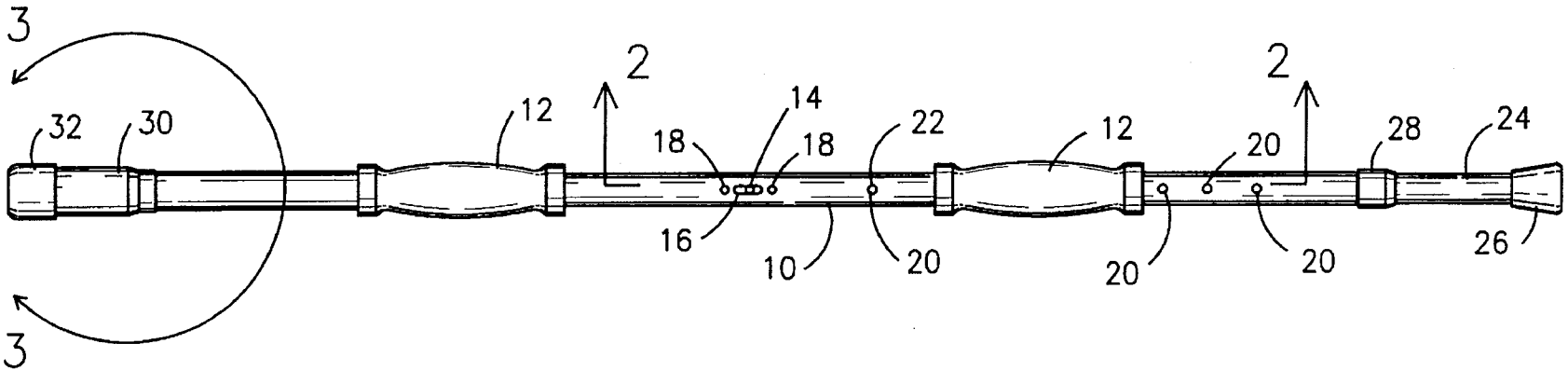
FIG. 1 is a top plan view of an EXERCISER LIGHT ALARM STICK according to the present invention.

In FIG. 1 a top plan view of the present invention is presented. The present invention may conveniently comprise a tube 10, which may be an aluminum tube, about which synthetic resin handles 12 or grip means 12 are disposed. In a generally central portion of tube 10, a switch 14 is mounted through opening 16 in tube 10. The switch 14 may conveniently be held in place using screws 18 or other well know means for fastening. Additional openings 20 are formed through tube 10 for passage of locking means 22, which will be further described below. Extension means 24, which may conveniently comprise a second aluminum tube 24, fits into the interior of the first aluminum tube 10, whereas handles 12 are disposed about the exterior of aluminum tube 10. End cover 26, suitable for contact with the ground, is placed upon the end of the second aluminum tube 24. This cover 26 may conveniently be synthetic resin or any other equivalent material known to the art. The second aluminum tube 24 is designed to slideably pass within the first aluminum tube 10 and to be locked in a variety of positions. When a desired position is reached, use of the friction nut 28 will help retain the second aluminum tube 24 into position. At the opposite end of the first aluminum tube 10, which may conveniently be referred to as the first end, while the end of the first aluminum tube 10 from which the second aluminum tube 24 extends may conveniently be referred to as the second end, the alarm light housing 30 may conveniently be attached. Although this is shown as a separate unit mounted to the first aluminum tube 10, the alarm light housing 30 may equally suitably be formed of the same piece as the first aluminum tube 10. A cover 32 is placed upon the end of the alarm light housing 30, having a hole formed therethrough for passage of light and possibly sound.

Figure 2:
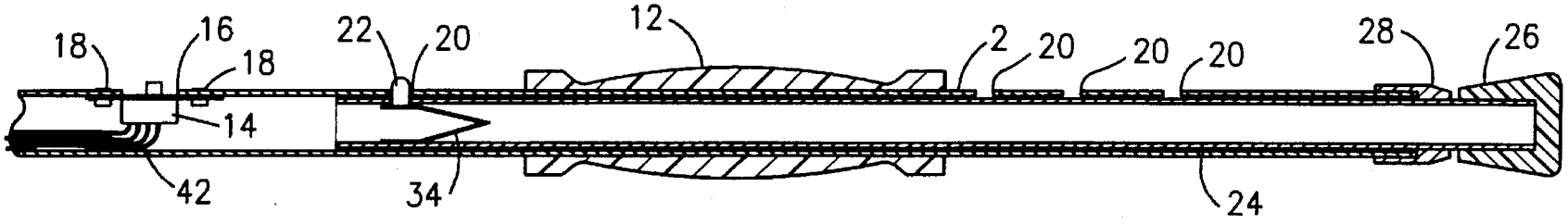
FIG. 2 is a fragmentary side cross section of the EXERCISER LIGHT ALARM STICK of FIG. 1 taken along line 2—2 of FIG. 1.

The detailed working of switch 14 and the second aluminum tube 24 can be seen in FIG. 2, a fragmentary side sectional view taken along line 2—2 of FIG. 1. In this view, the second aluminum tube 24 can be more clearly seen inside the first aluminum tube 10, where it is locked in place by locking means 22 actuated by spring clip 34. To adjust the position of the second aluminum tube 24, and thereby to extend the present invention's length, locking means 22 are depressed and the second aluminum tube 24 is moved to a new position where locking means 22 may pass through a different opening 20. For communication with the battery, generally indicated as 36, seen in FIG. 3, and with the light, generally indicated as 38, and alarm 40 or buzzer 40, wires 42 are shown in FIG. 2 traveling from the switch 14 to the battery 36, the light 38, and the alarm 40, by which the switch 14 is in electrical connection with the foregoing elements. Switch 14 may suitably be replaced by and is equivalent to use of a first and a second switch means for control of light 38 and alarm 40, respectively.

Figure 3:
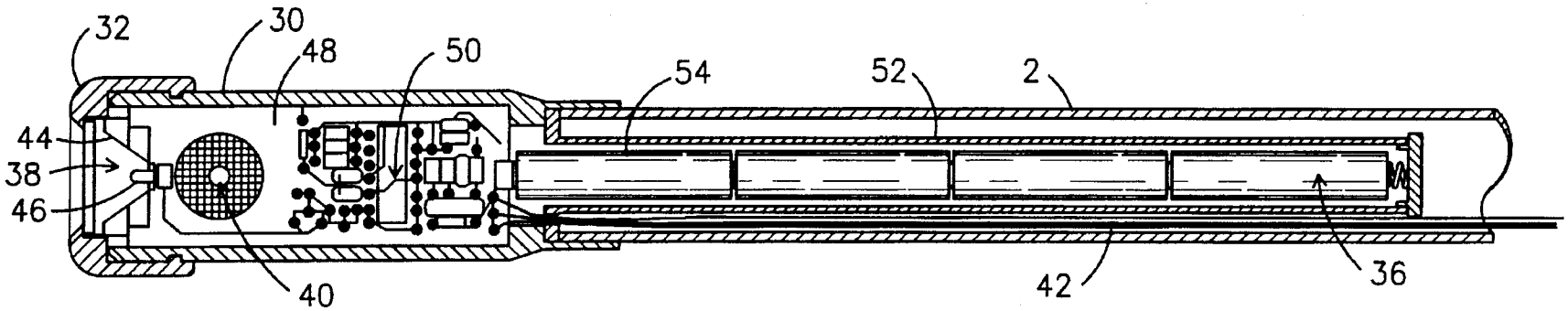
FIG. 3 is a fragmentary side cross section of the EXERCISER LIGHT ALARM STICK of FIG. 1 taken along line 3—3 of FIG. 1.

In FIG. 3, a fragmentary sectional view taken along line 3—3 of FIG. 1, the battery 36, light 38, and alarm 40 components of the present invention can be more clearly seen positioned within the alarm light housing 30. The light 38, or means 38 for projecting light, is composed of a reflector 44 and a bulb 46. A circuit board 48 may conveniently attach to or hold reflector 44 as well as buzzer 40, and may contain a circuit, generally indicated as 50, shown schematically in FIG. 4. In addition, circuit board 48 may connect to the battery, which comprises a battery housing 52 which may suitably contain one or more commercially well known chemical batteries 54.

Figure 4:
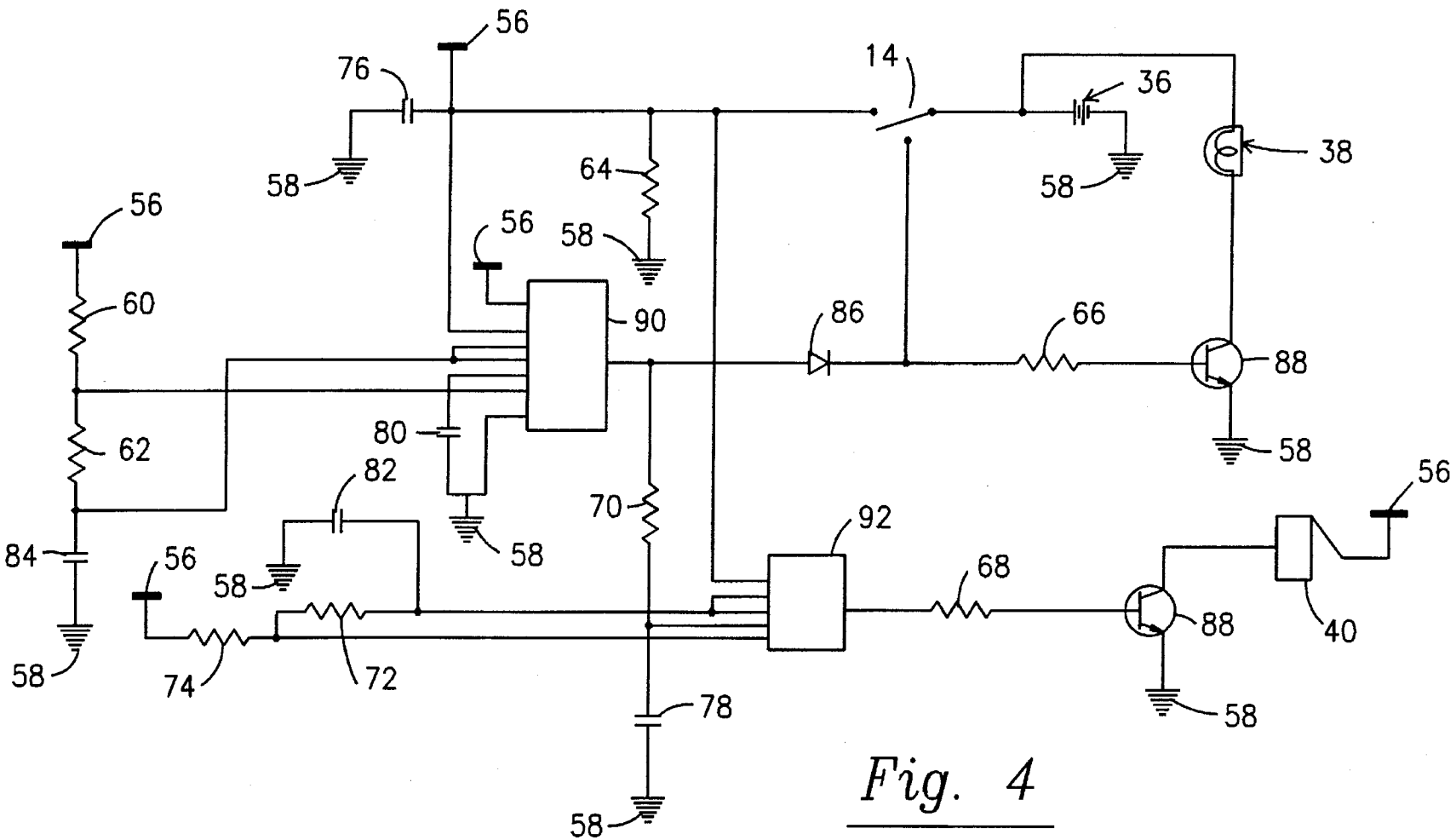
FIG. 4 is a schematic of a sample electronic circuit for controlling the present invention.

FIG. 4 shows a schematic representation of circuit 50 controlling the present invention. Battery 36 is used to provide voltage 56 which may be conveniently be six volts. In addition, the battery is used to provide a ground 58. In a preferred embodiment, the resistors 60–74 may conveniently have the following values:

Resistor 60 10,000Ω
Resistor 62 10,000Ω
Resistor 64 10,000Ω
Resistor 66 1,000Ω
Resistor 68 1,000Ω
Resistor 70 10,000Ω
Resistor 72 100,000Ω
Resistor 74 10,000Ω

The circuit shown in FIG. 4 includes several capacitors 76–84. In a preferred embodiment, capacitors 76–84 have the following values:

| | |
|---|---|
| Capacitor 76 | 1 μF |
| Capacitor 78 | 10 μF |
| Capacitor 80 | .01 μF |
| Capacitor 82 | .0033 μF |
| Capacitor 84 | 10 μF |

The remaining components are commonly available diodes, integrated circuits, transistors, lights, and buzzers. In a preferred embodiment, the specific part numbers and manufacturers used were Rohm 592-PN2222 for transistors 88 and 1N4148 for diode 86; Norman Lamp, Inc., part no. 1283 for bulb 38; CN Industries, switch no. SW119 (3 position switch 14); Panosonic, part no. 9971 for buzzer 40; and Harris, part no. ICM7556IPD for integrated circuits 90 and 92. In a preferred embodiment, integrated circuit 90 operates at a frequency of 3.175 Hz and integrated circuit 92 operates at a frequency of 3.448 kHz.

It will thus be seen that the objects set forth above and those made apparent from the preceding description are efficiently attained, and since certain changes may be made in the above article without departing from the scope of the invention, it is intended that all matter contained in the above description or shown in the accompanying drawings shall be interpreted as illustrative and not in limiting sense.

It is also to be understood that the following claims are intended to cover all of the generic and specific features herein described, and all statements of the scope of the invention which, as a matter of language, may be said to fall therebetween.

Now that the invention has been described:

What is claimed is:

1. A flashlight primarily intended for use as a cane, said flashlight comprising:

a tube having an exterior and interior, said tube having a first and a second end, said first end defining an alarm light housing;

means for extension engaging said tube and extending from said second end of said tube;

grip means disposed about said exterior of said tube;

a circuit board positioned within said housing;

a light disposed within said alarm light housing, said light comprising a reflector attached to said circuit board; and a bulb positioned adjacent said reflector;

switch means positioned proximal said grip means electrically connected to said bulb;

a battery means disposed in the interior of said tube electrically connected to said switch means; and alarm means for projecting sound disposed in said interior of said alarm light housing, said alarm means including a buzzer, with said buzzer attached to said circuit board and being electrically connected to said switch.

2. The flashlight of claim 1 wherein:

said tube comprises a first aluminum tube;

said means for extension comprises a second aluminum tube slideably passing through said interior of said first aluminum tube, further comprising means for locking said second aluminum tube in position within said first aluminum tube; and said grip means comprises at least one synthetic resin handle disposed about said first aluminum tube.

* * * * *